US005725361A

United States Patent [19]

Dantlgraber

[11] Patent Number: 5,725,361

[45] Date of Patent: Mar. 10, 1998

[54] HYDRAULIC UNIT

[75] Inventor: Jörg Dantlgraber, Lohr/Main, Germany

[73] Assignee: Mannesmann Rexroth GmbH, Lohr/Main, Germany

[21] Appl. No.: 495,437

[22] PCT Filed: Jan. 28, 1994

[86] PCT No.: PCT/EP94/00247

§ 371 Date: Jul. 5, 1995

§ 102(e) Date: Jul. 5, 1995

[87] PCT Pub. No.: WO94/18459

PCT Pub. Date: Aug. 18, 1994

[30] Foreign Application Priority Data

| | | | |
|---|---|---|---|
| Feb. 2, 1993 | [DE] | Germany | 43 02 843.8 |
| Aug. 4, 1993 | [DE] | Germany | 43 26 139.6 |
| Oct. 30, 1993 | [DE] | Germany | 43 37 131.0 |

[51] Int. Cl.[6] ..... F04B 39/00

[52] U.S. Cl. ..... 417/312; 417/313; 181/198

[58] Field of Search ..... 717/312, 313; 181/198, 207

[56] References Cited

U.S. PATENT DOCUMENTS

| | | | |
|---|---|---|---|
| 3,723,027 | 3/1973 | Montelius | 417/313 |
| 4,201,523 | 5/1980 | Olofsson | 417/312 |
| 4,569,637 | 2/1986 | Tuckey | 417/360 |
| 4,585,398 | 4/1986 | Drake | 417/367 |
| 5,169,531 | 12/1992 | Shiraga et al. | 417/312 |
| 5,211,547 | 5/1993 | Gaston et al. | 417/360 |
| 5,407,330 | 4/1995 | Rimington et al. | 417/312 |

FOREIGN PATENT DOCUMENTS

| | | | |
|---|---|---|---|
| 1900409 | 11/1969 | Germany . | |
| 2164258 | 7/1972 | Germany . | |
| 2157749 | 7/1976 | Germany . | |
| 2634129 | 2/1978 | Germany | 417/313 |
| 2804653 | 8/1979 | Germany | 417/313 |
| 2934666 | 3/1981 | Germany . | |
| 8204826 | 8/1982 | Germany . | |
| 8207794 | 8/1982 | Germany . | |
| 3709477 | 12/1987 | Germany . | |
| 3702904 | 8/1988 | Germany . | |

OTHER PUBLICATIONS

Book: Grundlagen und Komponenten der Fluid–Technik Hydraulik (*Principles and Components of Fluid Hydraulics*) vol. 1, 1991, published by Mannesmann Rexroth GmbH, p. 295 et seq., Exner et al.

*Primary Examiner*—Timothy Thorpe
*Assistant Examiner*—Peter G. Korytnyk
*Attorney, Agent, or Firm*—Martin A. Farber

[57] ABSTRACT

A hydraulic unit having a hollow oil container which has a receiving space for oil between an external outer wall and an internal outer wall, and having a pump unit which comprises an electric motor and a pump which can be driven by the electric motor. Such a hydraulic unit is to be further developed in such a manner that it has only a low noise level, in which connection also sufficient cooling of the hydraulic fluid and of the electric motor should be assured. This is achieved in the manner that at least the pump, and preferably the pump unit, is included in an enclosure which is formed by the hollow oil container and at least one sound-damping element.

22 Claims, 10 Drawing Sheets

HYDRAULIC UNIT

FIELD AND BACKGROUND OF THE INVENTION

The present invention relates to a hydraulic unit the essential parts of which are an oil container and a pump unit, wherein the container has an internal and an external outer wall with an oil receiving space between the walls. The oil container is hollow and has a receiving space for oil between an external outer wall and an internal outer wall. The pump unit comprises an electric motor and a pump which can be driven by the electric motor.

Such a hydraulic unit in which, furthermore, the electric motor is air cooled, is known from Federal Republic of Germany Utility Model 82 07 794. In that hydraulic unit, a hollow cylindrical oil container and the pump unit are arranged vertically. The oil container is substantially shorter than the pump unit and is spaced from the feet of a frame which supports the oil container and the pump unit. Below the oil container, a pipeline which is connected to the discharge connection of the pump is wound so as to form three pipe coils lying radially above one another. The inner space between the internal outer wall of the oil container and the pipe coils is hermetically closed in the vicinity of the bottom while it is covered on top by a ventilation grid. A fan wheel is arranged on the side of the electric motor opposite the pump between the electric motor and the ventilation grid. It is intended, in operation, to force outward through the ventilation grid air which it has drawn in from the outside through the pipe coils. It may be that the hydraulic oil flowing in the pipe coils can be cooled in this manner. However, it appears disadvantageous that the air which is heated upon flowing through the pipe coils passes along the electric motor to the fan wheel. Sufficient cooling of the electric motor does not appear to be assured by this. In addition to the problem of the production of heat and the cooling of the hydraulic oil as well as of the electric motor forming a part of the pump unit which is thereby necessary, the problem of the production of noise and of the damping of the noise has for some time come more and more into the foreground in connection with hydraulic units, under the slogan of the humanizing of work stations.

SUMMARY OF THE INVENTION

The object of the present invention is so to improve a hydraulic unit having the features set forth above so that its noise level is low. Furthermore, sufficient cooling of the hydraulic oil and of the pump unit, and particularly of the electric motor of the pump unit, is to be assured by a further development. The ease of assembly of the hydraulic unit is also to be the subject of attention.

The goal of a low emission of noise is obtained for a hydraulic unit of the foregoing type by providing a sound damping element. By means of the oil container and one or more sound-damping elements, the pump or pump unit is encapsulated so that the hydraulic unit has only a low noise level.

Advantageous embodiments of a hydraulic unit in accordance with the invention can be noted herein.

Primarily two principles are applied for the cooling of the electric motor of a hydraulic unit which drive a hydraulic pump. One of them is the principle of air cooling. In that case, there is associated with the electric motor a fan wheel which is generally driven by the electric motor itself and which, by means of a baffle plate, produces a flow of air which passes over cooling ribs on the outside of the motor housing. The second principle is liquid cooling of the electric motor by the oil present in an oil container of a hydraulic unit. For this type of cooling, the electric motor together with the pump is immersed in the oil present in the oil container. The unit consisting of electric motor and pump is then referred to as an under-oil unit. Due to the fact that the pump unit is immersed in the oil contained within an oil container, the emission of noise is already reduced as compared with a hydraulic unit in which the pump unit is located outside the oil container. A further reduction in noise is obtained if the oil container, refereed to in the following as second oil container, is received together with the under-oil unit in an enclosure which is formed essentially by the hollow, first oil container and at least one sound-damping element, the external outer wall of the second oil container and the internal outer wall of the first oil container being spaced from each other. The two oil containers are connected with each other for the exchange of oil so that heat which has passed from the electric motor to the oil can be discharged to the outside via the first oil container. Preferably, in operation, the pump will draw oil out of the second oil container, while a return line discharges into the first oil container so that a forced exchange of oil between the two containers takes place.

If the electric motor is air cooled, then, in accordance with one embodiment of the invention, a sound-damping element is used which is pervious to a stream of cooling air. The fan wheel draws cold air in from the outside over a sound-damping element, blows it over the electric motor, and forces it through it or a second sound-damping element back out of the inner space. A sound damping plate can consist of several foam plates arranged spaced one above the other and having openings staggered from each other. Since sound can only travel along a straight line, it is greatly damped by the staggered openings. On the other hand, air can pass into or out of the inner space through the openings.

As a further feature, it is provided that the hollow oil container be so large that the inner space limited by the internal outer wall receives the entire pump unit or the entire second oil container, and that a sound damping plate is present on one open side of the inner space. Due to the size of the hollow oil container, the external outer wall has a large surface over which heat exchange can take place between the oil in the oil container and a cooling agent, for instance air, which surrounds the oil container. This heat exchange is sufficient, in many cases, to keep the oil within the range of the operating temperature.

In a further aspect of the invention, the hollow oil container is developed as a hollow cylinder with two open ends, a sound-damping element being present at each end of the inner space. In this connection, it is not necessary for the hollow oil container to have the same cross section over its entire length. It is also possible, for instance, for the hollow oil container to be slightly frustoconical. It appears particularly suitable, however, for the hollow oil container to be a hollow cylinder which has the same cross section over its entire length. The plates from which the outer walls of the hollow oil container are made can then be shaped particularly easily.

In another preferred embodiment, the hollow oil container is developed in the manner of a trough having an open side, this open side being covered by a sound-damping element. The trough-like oil container can be arranged horizontally in such a manner that the inside is open towards the top in a direction opposite the force of gravity. There is then the advantage that a connecting point between the two outer walls can be located readily at a level above the maximum oil level so that the danger of leakage of the oil container is very slight. Furthermore, the trough-like oil container can then be open on the top and be merely provided with a cover. It is also possible to arrange the trough-like oil container vertically in such a manner that the inner space is open on the side, that the bottoms of the two outer walls are more or less vertical. Depending on the spatial conditions at the place of use of the aggregate, the pump unit may then be more easily accessible than with a different arrangement. The pump unit is preferably arranged horizontally with its axis parallel to the bottom of the trough in the oil container, the oil container being preferably of elongated development corresponding to the shape of the pump unit. The horizontal arrangement of the pump unit makes it possible in simple manner to provide a stream of cooling air through the inner space between two regions of the sound-damping element through which the stream of cooling air can pass. Furthermore, the stability under load is particularly high in the case of a horizontal arrangement of the oil container.

In accordance with another embodiment, the external outer wall of the trough-shaped hollow container is part of a machine stand and therefore, in addition to its function as part of the oil container, also has a load-bearing function for a machine. In particular, when the external outer wall is part of a machine stand, it is provided, in order to support the internal outer wall, on the inside of its shell with brackets by which the internal outer wall is supported. Another possibility of supporting the internal outer wall of a trough-shaped hollow container via the external outer wall is to provide, between the bottoms of the two outer walls, spacers on which the internal outer wall is seated. In a further aspect of the invention, on one open side, both outer walls of the hollow oil container are conducted outward by, in each case a flange-like section and the two flange-like sections lie directly, or via a spacer element, on top of each other. If the hollow oil container is of trough shape and so arranged that the trough is open towards the top then, in this way, the internal outer wall is supported by the external outer wall. The flange-like section can, in this case, be immediately produced upon the manufacture of the outer wall, for instance by a deep-drawing process.

When oil is in the oil container, a buoyancy force against which the internal outer wall is to be held in its position acts on the internal outer wall of the hollow oil container. This can take place in the manner, for instance, that the two outer walls the hollow oil container are firmly attached to each other, for instance by bolts or clamps. One possible solution is also to hold the internal outer wall, and via it also the external outer wall, firmly on a foundation. A particularly elegant solution consists, in accordance with a feature of the invention, in the weight of the pump unit or of the second oil container holding the internal outer wall down against the buoyancy force. Of course, both the weight of the pump unit and the weight of the oil container can also be active.

With one embodiment, the pump unit and/or the second oil container are supported by the hollow oil container. However, it also appears favorable if the hollow oil container and/or the pump unit and/or the second oil container are supported by a frame.

For the supporting of a trough-like oil container on a frame and for the seal between the two outer walls at the upper edge of the trough, it is advantageous if at least one outer wall of the oil container be guided outward by a flange-like section at one open side. The hollow oil container can easily be supported on the frame via the flange-like section of the outer wall. In this connection, the flange-like section will advantageously be surrounded by a clamp so that the hollow oil container cannot slide with respect to the frame. As a further feature, both outer walls are advantageously guided outward by a flange-like section and lie directly, or via a spacer, against each other, as a result of which they are positioned in height with respect to each other. By the use of spacers of different thickness, the volume of the trough-shaped oil container can be varied without other outer walls being necessary. Sealing between the two outer walls of the hollow oil container is effected preferably by means of an elastomeric packing between the two outer walls and by means of clamps which hold the two outer walls together with the interpositioning of the elastomeric packing.

In accordance with a further advantageous embodiment of a hydraulic unit in accordance with the invention, there is a trough-shaped hollow oil container, the pump unit can be sufficiently cooled.

By a shielding of the pump unit from the hollow oil container, the emission of noise from the aggregate is further reduced.

It also contributes to a reduction of the noise if, in accordance with a further aspect of the invention, a pulsation damper which is inserted in the delivery line of the pump is arranged within the inner space surrounded by the internal outer wall of the oil container. In this connection, the pulsation damper brings about a reduction in the emission of noise. The hollow oil container is preferably substantially rectangular on the outside in cross section so as to utilize as well as possible the structural space available.

If high cooling power for the hydraulic oil is necessary, then the hydraulic unit is advantageously so developed that an outer wall of the hollow oil container can be flowed around by a cooling liquid. For this, a third container wall can be provided spaced from the outer wall of the hollow oil container.

A hollow oil container can be formed in particularly simple manner from plastic by blow molding.

BRIEF DESCRIPTION OF THE DRAWINGS

With the above and other advantages in view, the present invention will become more clearly understood in connection with the detailed description of preferred embodiments, when considered with the accompanying drawings, of which.

DETAILED DESCRIPTION OF THE PREFERRED EMBODIMENTS

The essential parts of the hydraulic unit shown are a hollow oil container 10 and a pump unit 11 which are borne by a separate frame 12 in the embodiments of FIGS. 1 to 6 as well as 8 and 9.

Figure 1:
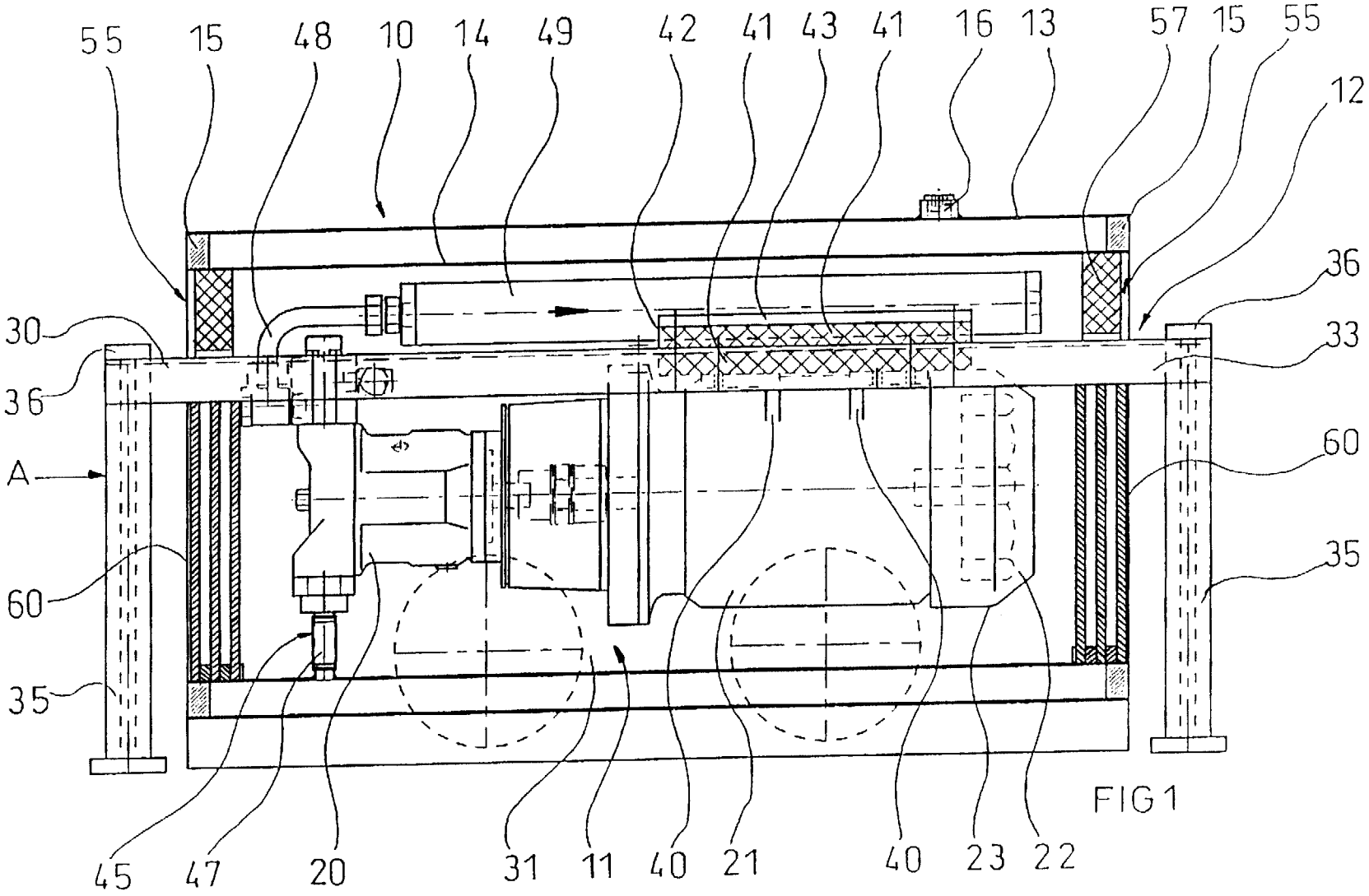
FIG. 1 is a side view, with the oil container cut in two, of a first embodiment which has a hollow oil container.
Figure 2:
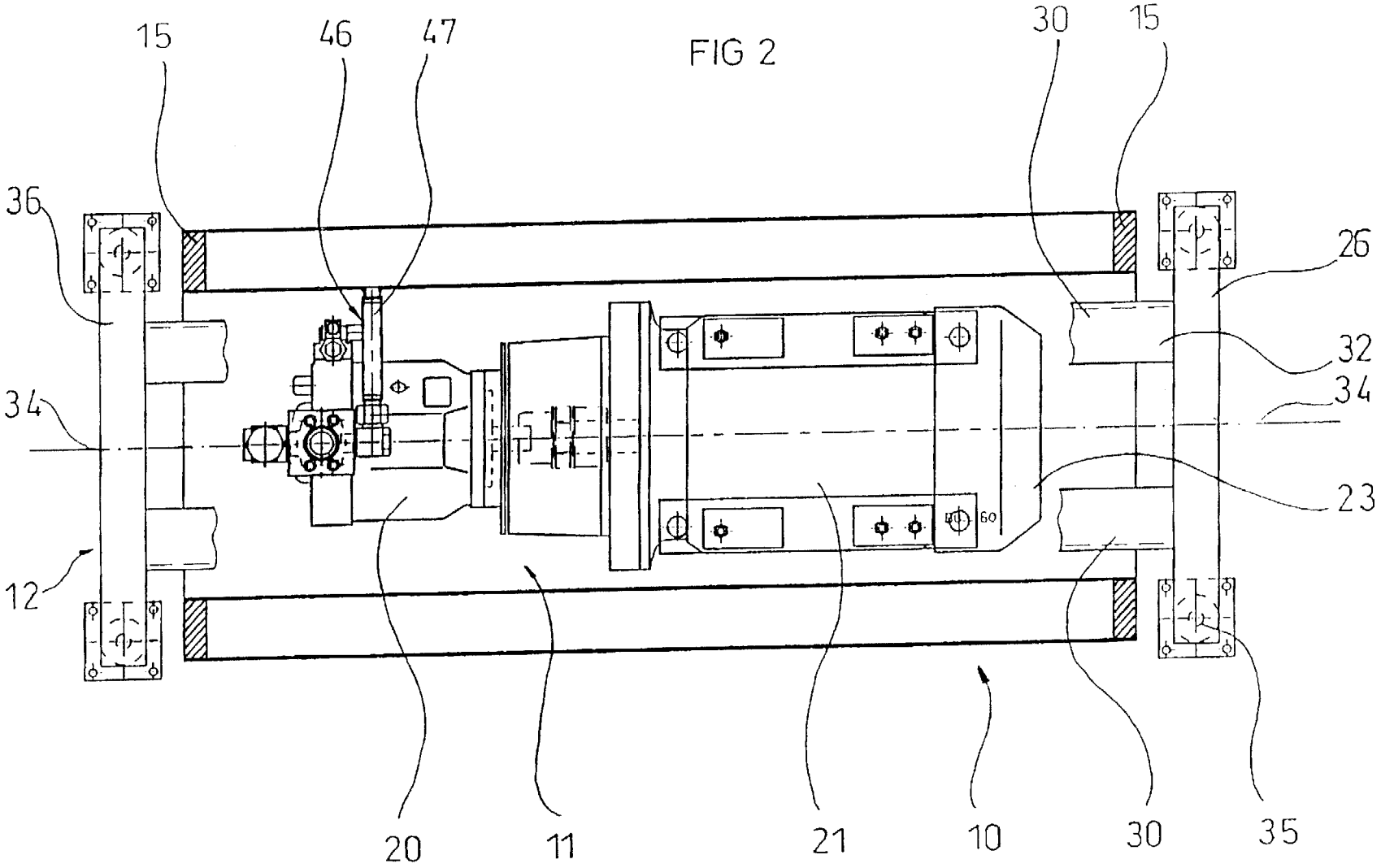
FIG. 2 is a top view, with the oil container cut in two, of the first embodiment.
Figure 3:
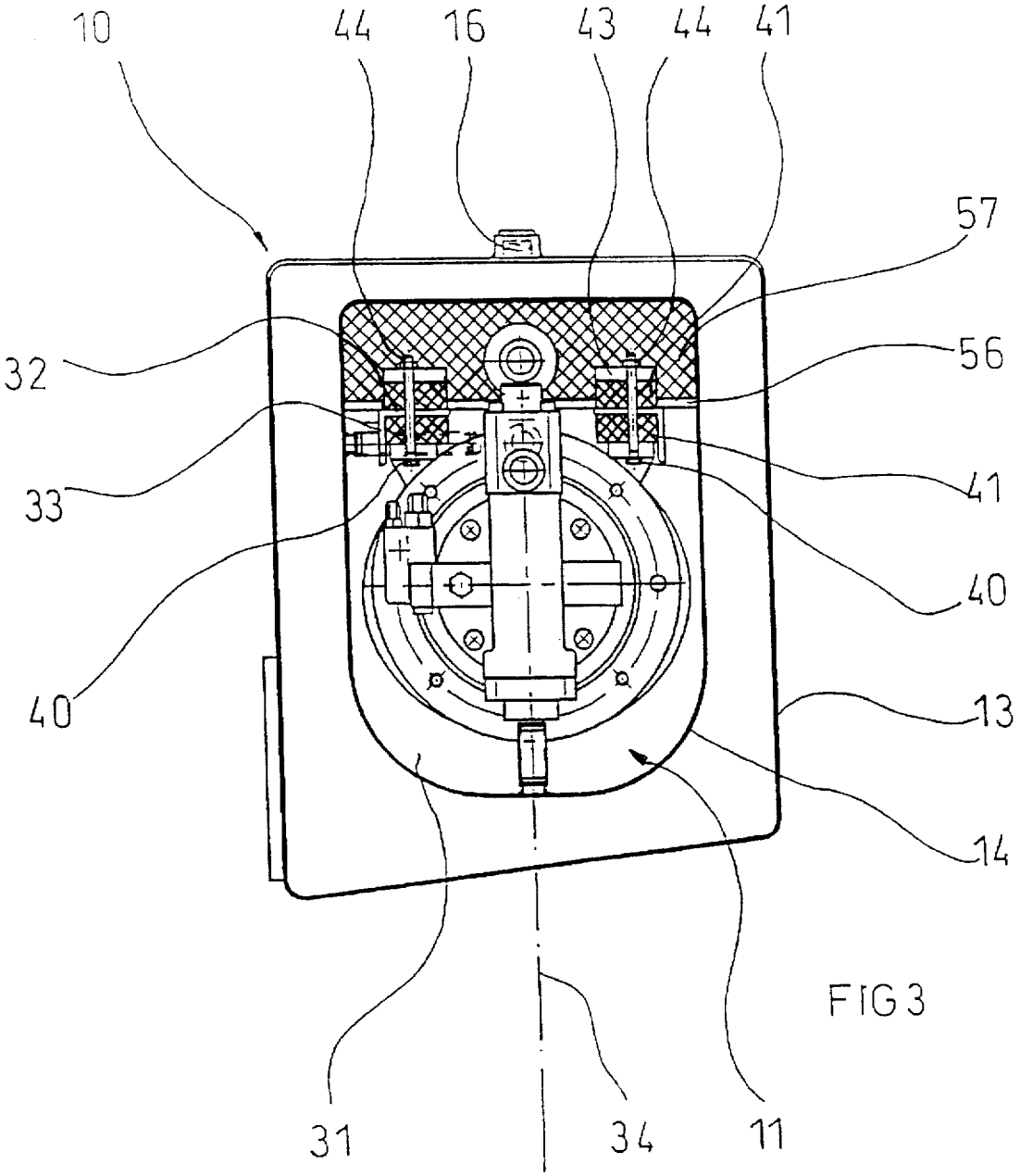
FIG. 3 is a view in the direction of the arrow A of FIG. 1, the end sound-damping plate being, however, omitted.

The oil container 10 of the embodiment in accordance with FIGS. 1 to 3 is of hollow-cylindrical development and therefore has the same cross section over its entire length, and it has an external outer wall 13 and an internal outer wall 14 between which an annular bottom 15 which fills the cross section between the internal outer wall and the external outer wall is inserted at each of the ends. In its outer cross section, the container is substantially rectangular. On the top of the external outer wall 13 there is seated a connection 16 for the introduction of oil and for the venting of the container. In the upper two corners, the internal outer wall 14 has the same small radius as the external outer wall at all four corners. The two lower corners of the internal outer wall 14 are less strongly curved.

In the embodiments according to FIGS. 1 to 7, the pump unit 11 is of ordinary commercial construction and is air-cooled. It includes a hydraulic pump 20, an electric motor 21 by which the hydraulic pump 20 is driven, as well as a fan wheel 22 which is fastened on one end of the electric motor 21 within a baffle plate 23 on the shaft of the electric motor and therefore is also driven by the electric motor. The fan wheel draws air in through end slits in the baffle plate 23 and forces it between a surrounding slit between the baffle plate 23 and the housing of the electric motor, so that the air flows along the outer side of the electric motor.

The frame 12 of the embodiment in accordance with FIGS. 1 to 3, has two longitudinal girders 30 which are developed as angle shapes and which extend approximately over two-thirds of the height of the inner space 31 which is surrounded by the internal outer wall 14 of the oil container through said inner space. The one leg 32 of the longitudinal girder 30 is arranged horizontally parallel to the upper sides of the external outer wall 13 and of the internal outer wall 14 and the other leg 33 is arranged perpendicular to said upper sides. In order that the longitudinal girders can extend as close as possible to the pump unit, the corresponding vertical leg is located on the longitudinal edge of the corresponding horizontal leg 32 which is further away for the middle plane 34 present between the two longitudinal girders, and therefore the outer longitudinal edge. The longitudinal girders 30 extend beyond the oil container 10 at its ends and are rigidly connected to each other in front of each end by a transverse girder 36. Each transverse girder 36, in its turn, extends laterally beyond the longitudinal girders 30 and lies there on a frame post 35. The frame posts 35 are thus substantially outside the area circumscribed by the internal outer wall 14 of the oil container 10, and therefore outside the cross-sectional area of the inner space 31.

The pump unit 11 is suspended within the oil container 10 in the inner space 31 from the longitudinal girders 30 of the frame 12. For this purpose, four holding angles 40 are arranged on the electric motor 21. Between two holding angles present below a longitudinal girder 30 and the leg 32 of the corresponding longitudinal girder, there is inserted an elastic body 41 which extends along the longitudinal girder. It can be considered a damping support. Precisely above the elastic body 41 a second damping support 42 lies on the other side of the leg 32, this second damping support 42 having, in addition to an elastic body 41 which rests directly on the leg 32, above the elastic body, also a dimensionally stable plate 43. Through each holding angle 40, the damping support 41, the leg 32 of the longitudinal girder, and the damping support 42, there is inserted a threaded bolt onto which a nut is screwed below the holding angle 40 and above the dimensionally stable plate 43. By means of the clamping means 44, consisting of the threaded bolt and the two nuts, a holding angle, the two damping supports 41 and 42, and the longitudinal girder are held together. The pump unit is thus suspended in sound-insulated manner on the frame 12. In this connection, it is also seen to it that the holding angles 40 as well as the clamping means 44 do not contact the longitudinal girders 30.

The hydraulic pump 20 is connected to the oil container 10 via a suction line 45 and another line 46. In order that no solid-conducted sound and no vibrations can be transmitted via these lines to the oil container 10, a length of hose 47 is inserted in each of the two lines 45 and 46.

The insertion of a pulsation damper 49 within the inner space 31 in the delivery line 48 of the hydraulic pump 20 also contributes to a damping of the noise.

The oil container 10 lies freely via two damping supports 55 on the longitudinal girders 30. Each damping support 55 is located at one end of the oil container and consists of a stable plate 56 which extends transversely over the two longitudinal girders 40 and of an elastic body 47 which substantially fills the cross section between the plate 56 and the internal outer wall 14 of the oil container 10 and rests against three sides of the internal outer wall 14. Thus, the oil container cannot move in a direction perpendicular to its lengthwise direction relative to the damping support 55. The stable plate can be firmly attached, for instance by bolting, to the longitudinal girders 30 in order to prevent it from slipping on the longitudinal girders. Between the pump unit 11 and the oil container there are therefore two sound damping transitions, so that excellent isolating of vibrations and sound-transmitted noise is assured.

By the damping supports 55, the inner space 31 is closed off at the ends of the oil container 10 in the region above the longitudinal girders 30. Furthermore, for the complete closing of an end, a sound-damping plate 60 is used which consists of several layers of foam, spaced apart from each other, with openings distributed over the entire surface of a layer. The openings in two adjacent foam layers are staggered from each other so that, on the one hand, air can pass into or out of the inner space 31 and, on the other hand, noise produced by the pump unit can pass through the outside only in damped form since sound can travel only over a straight line. A so-called sound labyrinth is created by the different layers. In the region of the longitudinal girders 30, each sound-damping plate 60 is recessed in a manner corresponding to the contour of each longitudinal girder so that the legs 32 and 33 of a longitudinal girder can pass through it. Outside the longitudinal girders 30, each sound-damping plate 60 extends up to the stable plate 56 of the damping support 55 associated with the corresponding end. Thus, the pump unit 11 and the pulsation damper 49 are located within the enclosed inner space 31. A high damping of noise is thus assured. Of course, an opening is present in one of the damping supports 55 or one of the sound-damping plates 60 for a further line (not shown in detail) connected to the pulsation damper 49. It has been found that the insertion of a pulsation damper in the delivery line directly at the pressure output of the pump by itself brings about, in addition to the damping of the pressure pulsations in the hydraulic fluid, also a substantial reduction of noise. The additional provision of the pulsation damper in an enclosed hollow space reduces the noise level which can be perceived from the outside. The unit can also be arranged vertically.

Figure 4:
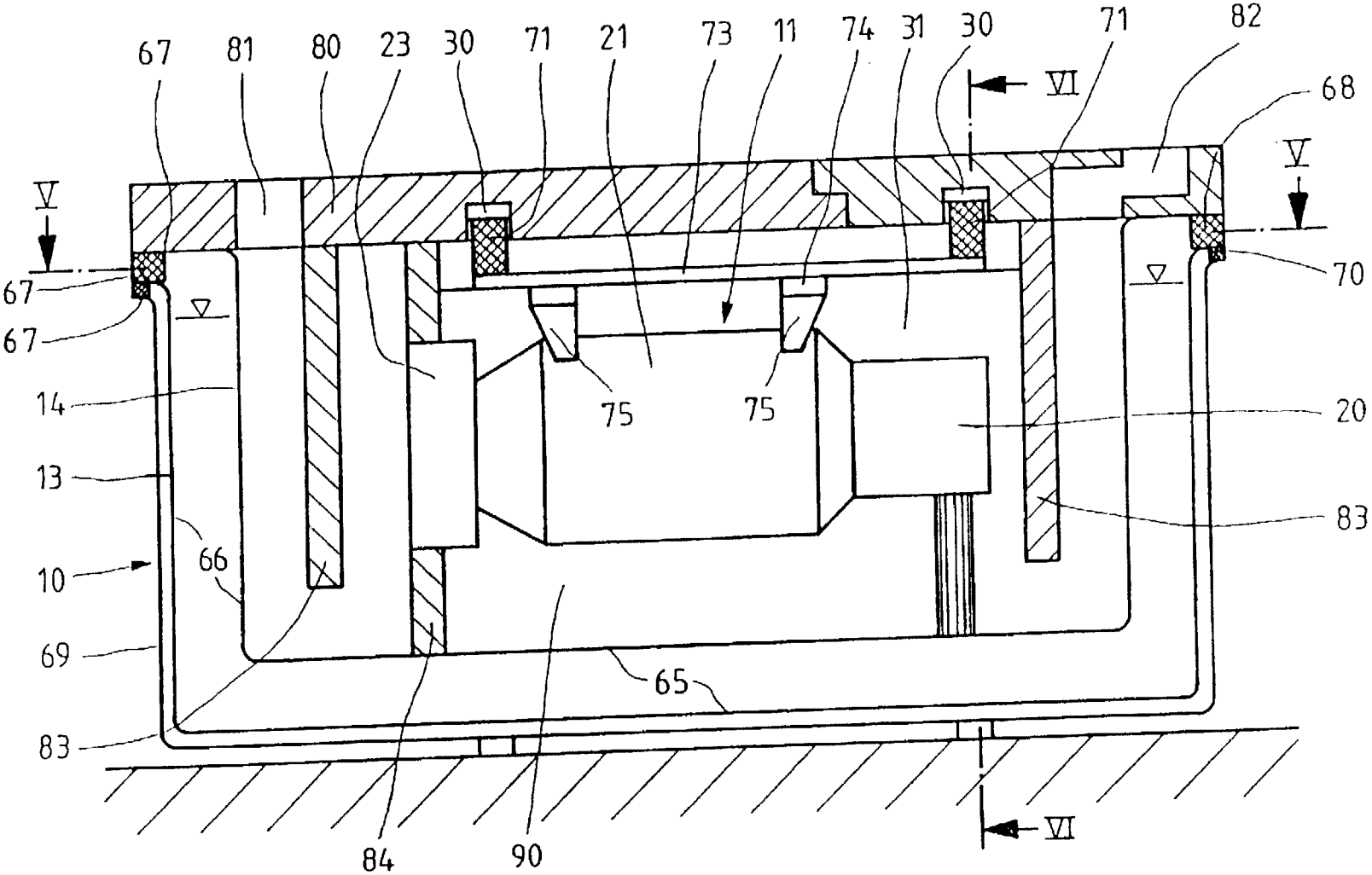
FIG. 4 is a longitudinal section through a second embodiment which has a trough-shaped oil container, the pump unit not being in section.
Figure 5:
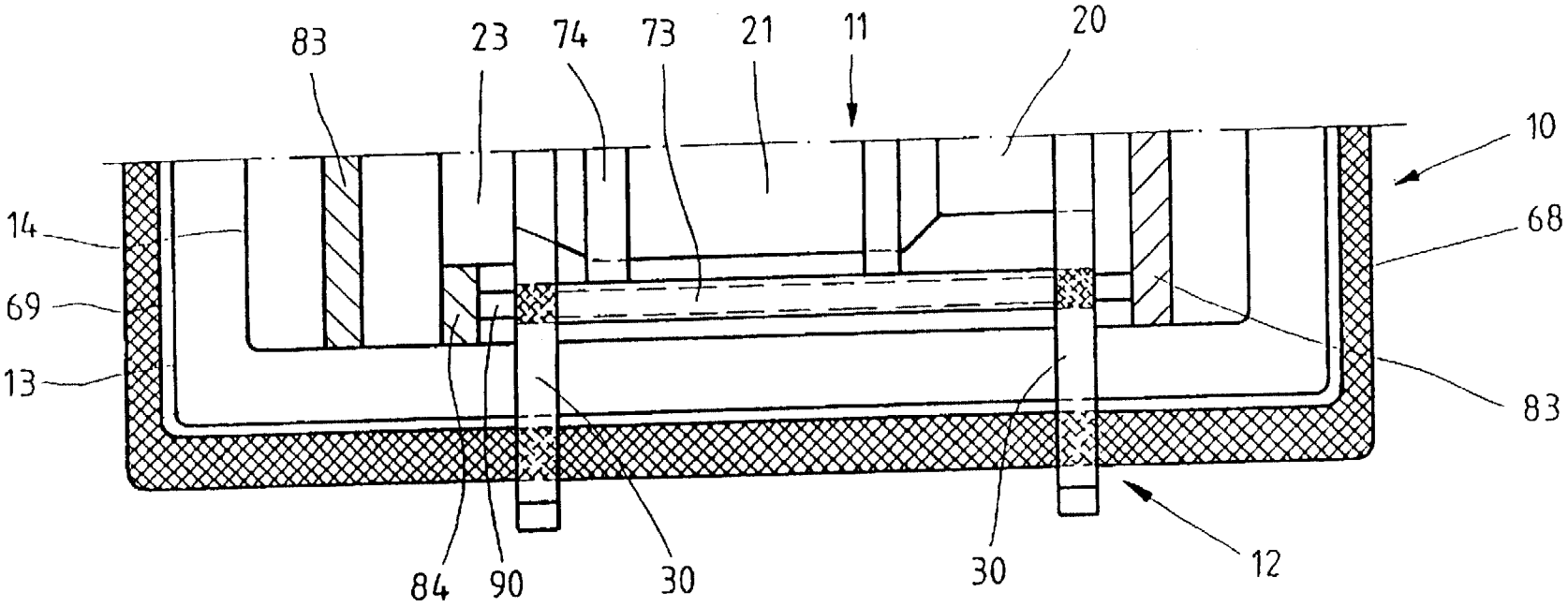
FIG. 5 is a section along the line V—V of FIG. 1, only a half of the unit being shown.
Figure 6:
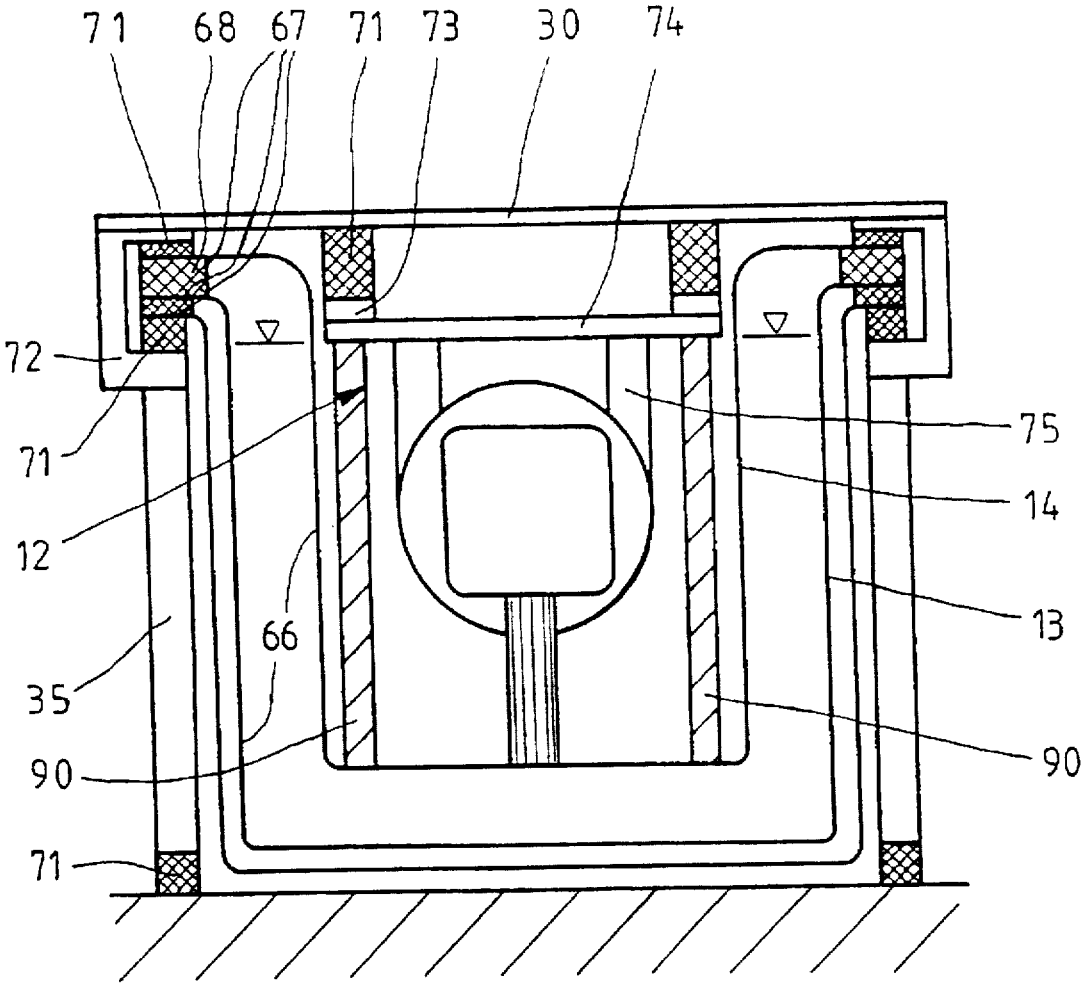
FIG. 6 is a section along the line VI—VI of FIG. 4.

The hydraulic unit of FIGS. 4 to 6 has a trough-like oil container 10 the two outer walls 13 and 14 of which are deep-drawn and each of which has a bottom 65, four side parts 66, and a flange 67 which is extended outward at the upper edge. Between the outer walls 13 and 14, there is the same distance everywhere in the region of the bottom and the side parts. The distances, in particular, between the bottoms 65 on the one hand and the side parts 66 on the other hand can, however, also be different. Two facing side parts of each outer wall are longer than the other two side parts, so that the oil container 10, as a whole, has an elongated shape. The flange 67 of the internal outer wall 40 is wider than the flange 67 of the external outer wall 13. Both flanges 67 terminate precisely one above the other. Between the flanges 67 there is inserted an elastomeric packing 68 which, in a manner similar to the bottoms 15 of the embodiment of FIGS. 1 to 3, closes off the space receiving the hydraulic oil between the two outer walls 13 and 14 from the outside, but is above the maximum intended oil level, indicated by arrows in FIGS. 4 and 6, so that in the case of the oil container of the unit of FIGS. 4 to 6, the danger of leakage is very slight. From the figures it can be noted that the bottoms 65 of the two outer walls 13 and 14 are of different size. The same is true of the side parts 66 and the flanges 67. It is possible to develop the outer walls in the manner of truncated pyramids so that a space for the receiving of oil can be obtained even with completely identical outer walls. By different heights of the elastomeric packing 68, which also acts as spacer, the volume of the intermediate space can be made of different size. The elastomeric packing also serves for the insulating of solid-conducted noise between the internal and external outer walls of the oil container.

The outer wall 13 is surrounded at a slight distance from another container wall 69, the upper edge of which is also guided towards the outside as a flange-like section 67. Water, by which hydraulic oil present between the two outer walls 13 and 14 can be cooled, can flow between the outer wall 13 and the container wall 69. By suitable barriers between the two walls 13 and 69, it can be seen to it that the water flows in the manner of a cooling coil from an inlet to an outlet. An elastomeric packing 70 is present between the flanges 67 of the outer wall 13 and the container wall 69.

The pump unit 11 of the embodiment according to FIGS. 4 to 6 is also entirely within the inner space 31 delimited by the internal outer wall 14 and again has an electric motor 21 by which a hydraulic pump 20 and a fan wheel present within a baffle plate 23 can be driven. The pump unit 11 is arranged with its axis in the longitudinal direction the oil container 10 within the inner space 31 thereof, and is suspended on a frame 12. This frame includes, similar to the embodiment according to FIGS. 1 to 3, four frame posts 35, two of which are present on a lengthwise side of the oil container 10, outside the latter. The oil container 10 has its flanges 67 resting via damping supports 71 on the frame posts 35. A damping support 71 is also inserted between a foundation and each frame post 35. At each frame post 35 the three flanges 67 are held together by a clamp 72, with the interposed elastomeric packings 68 and 70, as well as with the damping support 71 present below the flange 67 of the container wall 69 and with another damping support placed on the flange 67 of the internal outer wall 14. Two girders 30 extend above the oil container 10 transversely over the inner space 31 and are fastened in each case on two frame posts 35 arranged opposite each other. Within the inner space 31, the two girders 30 are connected to each other by two additional girders 73 which extend in the lengthwise direction of the container 10 and are suspended via damping supports 71 from the girders 30. The girders 73 are located close to the internal outer wall 14 of the oil container 10, so that they do not unnecessarily impede access to the hydraulic pump 20 over which the one girder 30 extends. Finally, two other girders 74 which extend parallel to the girders 30 but are at a smaller distance apart than the girders 30 are fastened directly to the girders 73, the pump unit 11 being suspended from said girders 74 by fastening lugs 75 which are developed integral with the housing of the electric motor 21. It is also conceivable to reduce the distance between the girders 73 or to have the fasting lugs 75 extend obliquely outward so that the pump unit 11 can be fastened directly on the girders 73 and the girders 74 can be dispensed with.

On the flange 67 of the internal outer wall 14 of the oil container 10 there is placed a bipartite sound-damping plate 80 which is divided in the region of the interface between electric motor 21 and hydraulic pump 20 so that only the one part of the sound-damping plate 80 need be lifted for access to the hydraulic pump 20. The sound-damping plate has corresponding recesses for the girders 30, the damping supports 71 between the girders 30 and the girders 73, as well as for the clamps 72. In the region of each narrow side part of the oil container 10, the sound-damping plate 80 is provided with an opening 81 and 82 respectively, which openings discharge directly within the side parts 66 of the internal outer wall 14 into the inner space 31. Towards the pump unit 11, the openings 81 and 82 are each screened off by a sound-damping plate 83 which is arranged perpendicular to the longitudinal axis of the pump unit 11 and extends from the sound-damping plate 80 into the inner space 81 but is spaced from the bottom 65 of the internal outer wall 14 of the container 10. The sound-damping plates 83 can be air-pervious over their entire surface. On the other hand, a partition wall 84, which is arranged transverse to the axis of the pump unit 11 and extends between the baffle plate 23, on the one hand, and the internal outer wall 14 of the oil container 10 and the sound-damping plate 80, on the other hand, is not air-pervious. The partition wall 84 sees to it that the fan wheel which in each case only draws in air from the passage 81 and that a closed air flow leading over the fan wheel is not produced within the inner space 31.

In operation, air flows through the passage 81 of the sound-damping plate 80 into the inner space 31, and passes between the sound-damping plate 83 associated with the passage 81 and the bottom of the internal outer wall 14 to the fan wheel, it is forced by the latter along the pump unit 11 and flows around the other sound-damping plate 83 to the passage 82, through which it passes again into the open. As can be seen, the two mouths of the passage 82 into the inner space 31 and into the open air are staggered with respect to each other by the width of this passage. Naturally, the passage 81 can also be developed in this manner. The noise emission of the hydraulic unit is thereby further reduced.

While the permeability for a stream of cold air in the case of the sound-damping plate 80 is created primarily by the passages 81 and 82, the sound-damping plates 60 of the embodiment in FIGS. 1 to 3 are air-pervious on their surface.

The pump unit 11 is screened off from the oil container 10, by sound-damping plates 90 which are arranged between the pump unit 11 and the long side parts of the internal outer wall 14 and extend between the wall 84 and the one wall 83. For example, plates available on the market under the name "Compact Absorbers" can be used for this.

Figure 7:
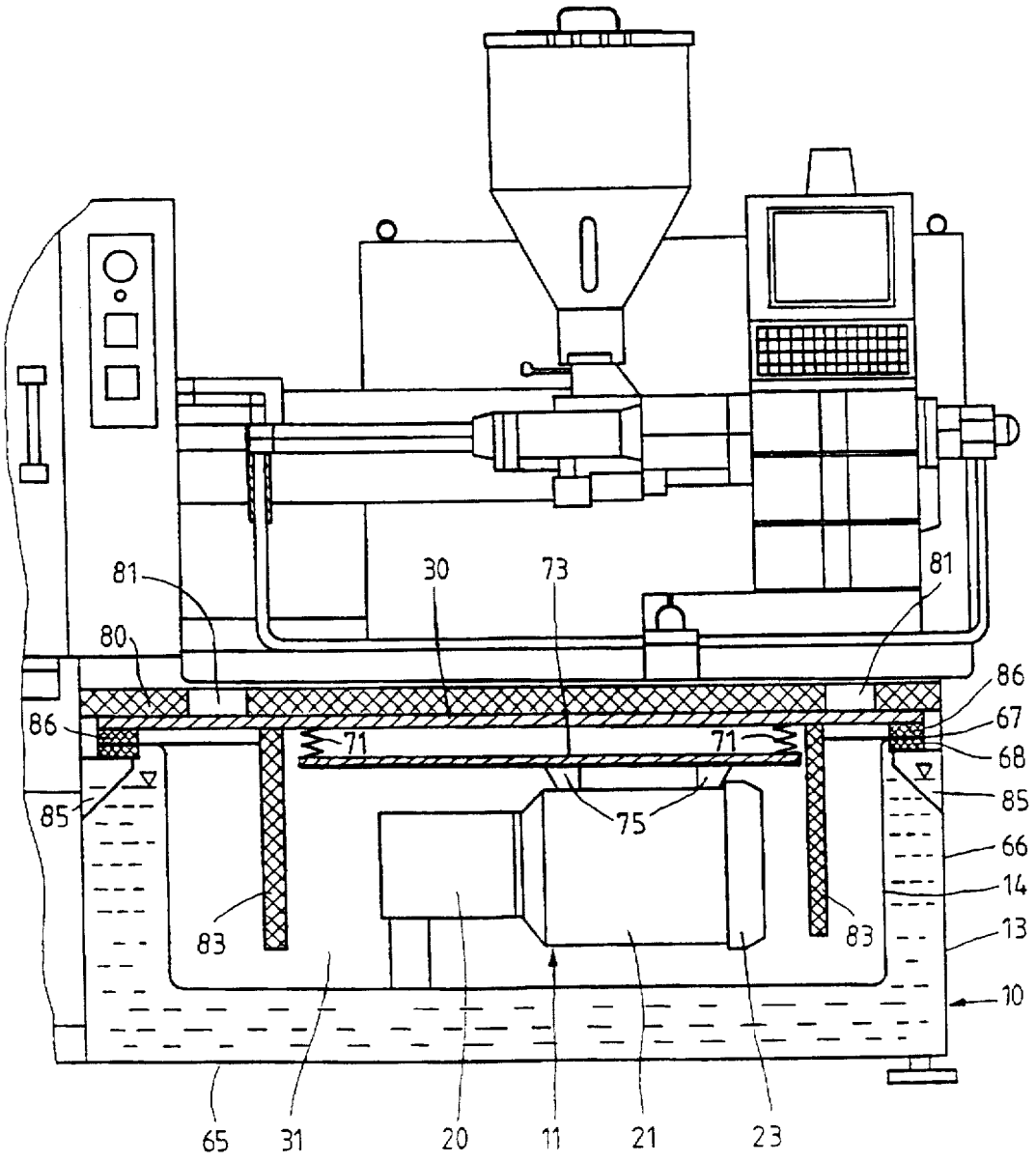
FIG. 7 is a third embodiment, which has a trough-shaped hollow oil container the external outer wall of which is part of a machine frame of a plastic injection molding machine.

The hydraulic unit for the plastic injection molding machine shown in part in FIG. 7 is, in principle, of the same construction as the hydraulic unit of FIGS. 4 to 6. A trough-like hollow oil container 10 has a trough-like external outer wall 13 and a trough-like internal outer wall 14 which encloses an inner space 31 in which the entire pump unit 11 is contained. The latter consists of an air-cooled electric motor 21 having a fan wheel present within a baffle plate 23, and a hydraulic pump 22 which can be driven by the electric motor 21.

One essential difference between the embodiment of FIG. 7 and the embodiment of FIGS. 4 to 6 is that the external outer wall 13 of the embodiment of FIG. 7 is now part of the machine stand of the plastic injection molding machine. In particular, the side parts 66 of the external outer wall 13 therefore have a load-bearing function for the machine. Spaced from the bottom 65, brackets 85 fastened on the inside of the side parts 66, a flange 67 of the internal outer wall 14 of the oil container 10 resting on said brackets via a spacer 68 which can also serve as packing.

The pump unit 11 is fastened, via fastening lugs 75, to two girders 73 which are suspended via damping elements 71 from two longitudinal girders 30. The latter rest via damping supports 86 on the flange 67 of the internal outer wall 14. The weight of the pump unit 11 therefore acts on the internal outer wall 14 of the oil container 10 and holds it on the brackets 85 against the force of buoyancy of the oil present in the container 10. No special fastening elements, for instance screws or bolts, are necessary between the flange 67 and the brackets 85. The elastomeric packing 68 and the damping supports 86 can easily be so developed that the internal outer wall 14 and the pump unit 11 cannot slide relative to each other and to the external outer wall 13. As in the embodiment of FIGS. 4 to 6, the inner space 31 is covered by a sound-damping plate 80. This plate has the passages 81 which lie in the air stream which cools the electric motor. By sound-damping plates 83 which are arranged perpendicular to the sound-damping plate 81, the passages 81 are covered off from the pump unit 11. As can be noted from FIG. 7 and the above description, the pump unit 11 is borne by the internal outer wall 13 of the oil container 10, and therefore by the oil container 10. An additional frame is not present in this embodiment.

Figure 8:
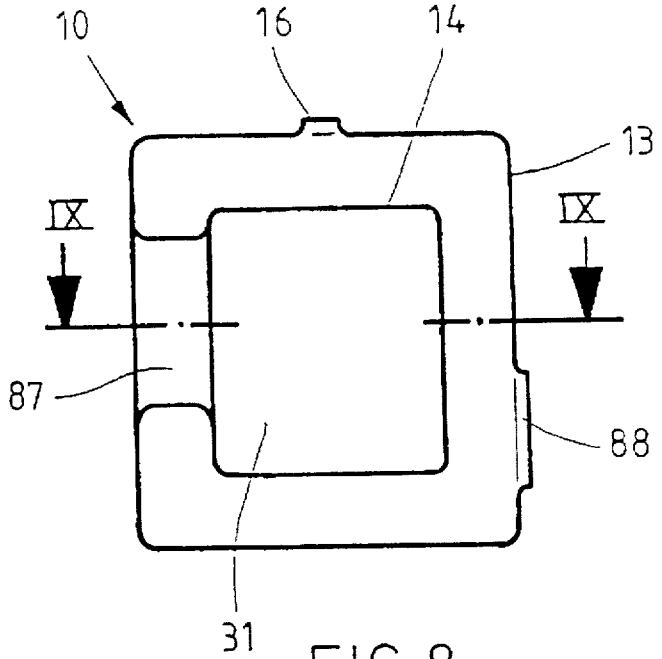
FIG. 8 is a section along the line VIII—VIII of FIG. 9 through a hollow-cylindrical oil container of the fourth embodiment which consists of plastic and is produced by blow molding.
Figure 9:
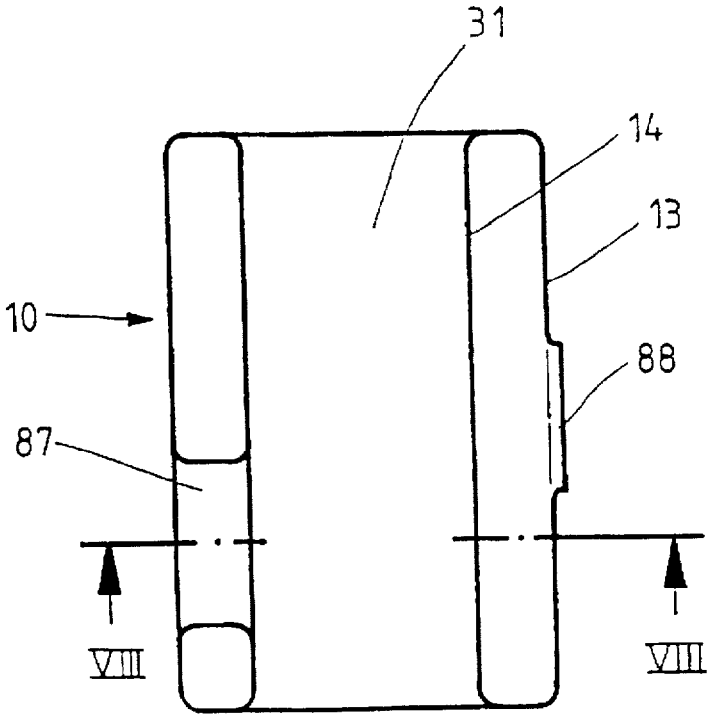
FIG. 9 is a section along the line IX—IX of FIG. 8.

The hollow-cylindrical oil container 10 of FIGS. 8 and 9 is made in one piece from plastic by blow molding; it has a maintenance opening 87 which extends from the outside through the outer walls 13 and 14 into the inner space 31 and is located at such a place that a pump present in the inner space 31 is easily reached through it. The maintenance opening is normally closed by a sound-damping insert and is opened only for maintenance. On the oil container 10 there are integrally developed a connection 16 which serves for the introduction of oil, and a connection 18 which surrounds a cleaning opening and which, considered in the lengthwise direction of oil container 10, is located in the center of the oil container.

The two hydraulic units of FIGS. 10 and 11 again have, in the same way as the embodiments of FIGS. 4 to 6 and FIG. 7, a trough-shaped hollow oil container 10 with an external trough-shaped outer wall 13 and an internal trough-shaped outer wall 14. The bottom 65 of the outer wall 13 rests via block-like elastic supports 89 on a foundation 90. By further elastic supports 89, which are located precisely opposite the supports between the outer wall 13 and the foundation 90, the bottom 65 of the outer wall 14 is held spaced from the bottom 65 of the outer wall 13 and the outer wall 14 rests on the outer wall 13.

Figure 11:
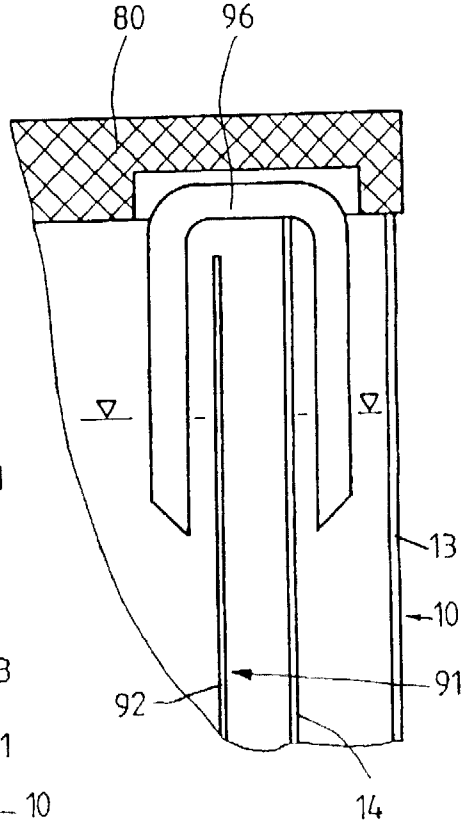
FIG. 11 shows a portion of a sixth embodiment which agrees substantially to that of FIG. 10 but in which the two oil containers are connected to each other by a riser pipe.
Figure 10:
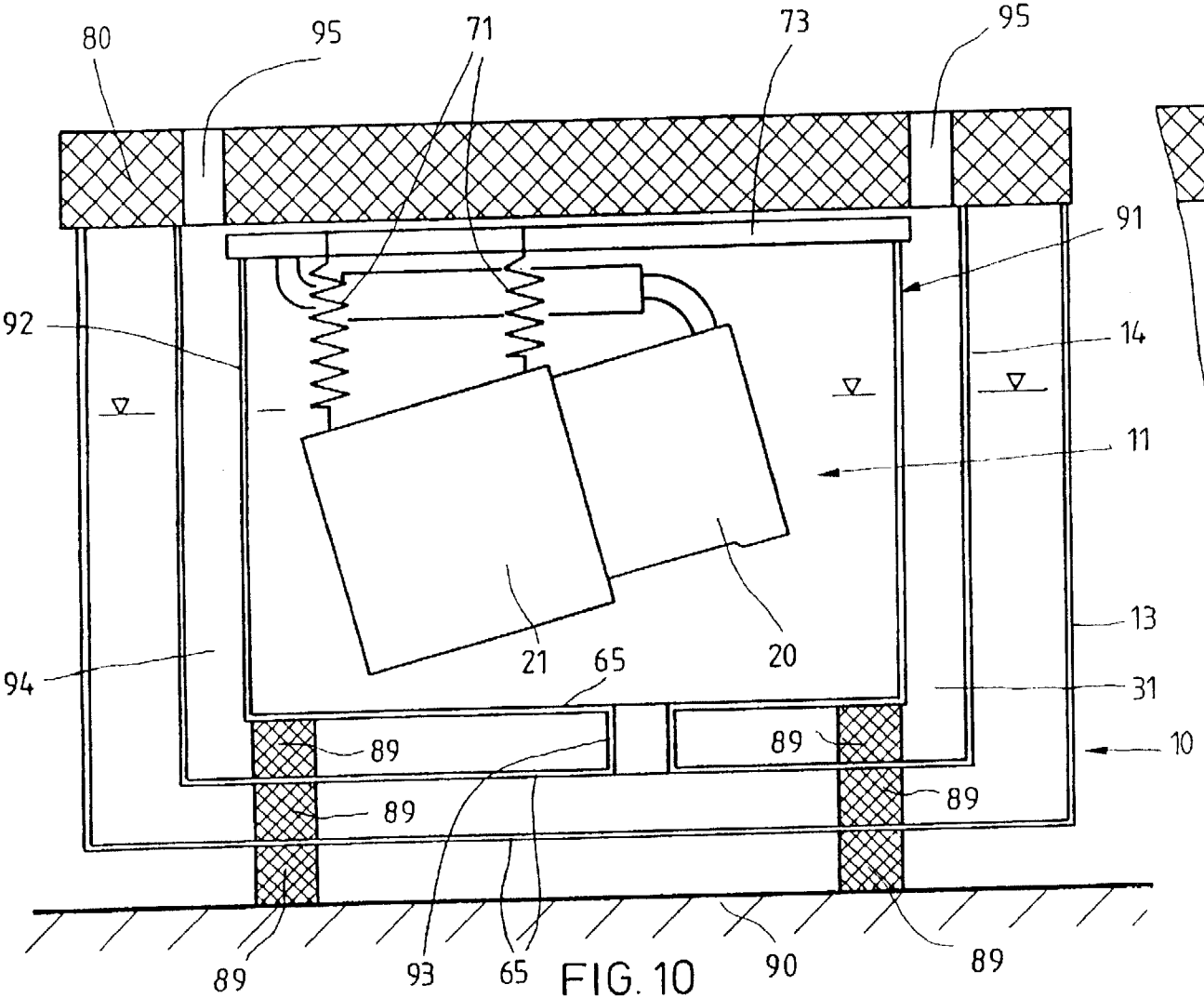
FIG. 10 is a fifth embodiment which has a trough-shaped hollow oil container which surrounds, at a distance, a second oil container having an under-oil unit, and in which the two oil containers are connected to each other in the manner of communicating pipes.

The pump unit 11 of the two embodiments of FIGS. 10 and 11 is a so-called under-oil unit which has no fan wheel and which is immersed in oil within a second oil container 91. The pump unit 11 is so obliquely suspended on two girders 73 via elastic supports 71 that the electric motor 21 is practically completely under oil, but a region of the pump 20 extends out of the oil. In this region of the pump, electronic components, for instance, can be present, they remaining free of oil in advantageous manner.

The second oil container 91 is located within the inner space 31 defined by the internal outer wall 14 of the first oil container; it is of customary construction and has a single, trough-shaped outer wall 92 the bottom 65 of which is held spaced via elastic supports 89 from the bottom 65 of the internal outer wall 14 of the first oil container 10. Furthermore, there is a space between the side parts of the outer walls 14 and 92. The girders 73 lie on the outer wall 92 of the second oil container so that, in addition to the weight of the oil container 91, also the weight of the pump unit 11 holds the internal outer wall 14 of the oil container 10 down over the uppermost blocks. A firm attachment between the two outer walls 13 and 14 of the oil container 10 or a direct connection of the internal outer wall 14 to the foundation 90 is not necessary.

The two oil containers 10 and 91 communicate with each other via a pipe 93 which extends through the space 94 between the outer walls 14 and 92 and extends in each case from an opening in the bottom 65 of these two outer walls. Instead of a pipe, an elastic hose can also be used. The pump 20 advantageously draws in oil which is present in the second oil container 91, while the return flow line debouches into the first oil container 10 so that an exchange of oil takes place in positive manner between the oil containers. The hot oil coming from the return flow line gives off its heat primarily via the external outer wall 13 of the oil container 10, but also via the internal outer wall 14 of this oil container. The outer wall 92 of the second oil container also contributes to the discharge of heat.

Both oil containers 10 and 91 are covered by a sound-damping plate 80. In the region of the space 94, this plate has air slits 95 so that the air present in the space 94 can be exchanged and heat can be transported outwards. Depending on the cooling necessary, a flow of cooling air or a flow of cooling water though the intermediate space 94 can also be produced. Instead of the relatively block-shaped supports 89, supports can also be used which have a polygonal recess in which a corner of the trough-shaped outer walls 13, 14 and 92 is seated. At the same time, the supports 89 which are present between the outer walls can extend up into the inner corners of the outer walls 13 and 14. In this way, they position the outer walls with respect to each other. For a greater damping of noise, the intermediate space 94 can be filled with sand.

In the embodiment shown in FIG. 10, a direct connection exists via the pipe 93, even if it is developed as an elastic hose, between the internal outer wall 14 of the oil container 10 and the outer wall 92 of the oil container 91. This is avoided in the embodiment of FIG. 11, in which the two oil spaces in the oil containers 10 and 91 are in exchange communication with each other via a U-shaped riser pipe 96 which extends over the outer wall 92 of the oil container 91 and over the internal outer wall 14 of the oil container 10 and with its one end dips into the oil present in the oil container 91 and with its other end into the oil present in the oil container 10. With such a construction, there is no danger of a place of connection between the two oil containers leaking and of oil passing into the intermediate space 94. The riser pipe can, for instance, be held on the sound-damping plate 80.

Figure 12:
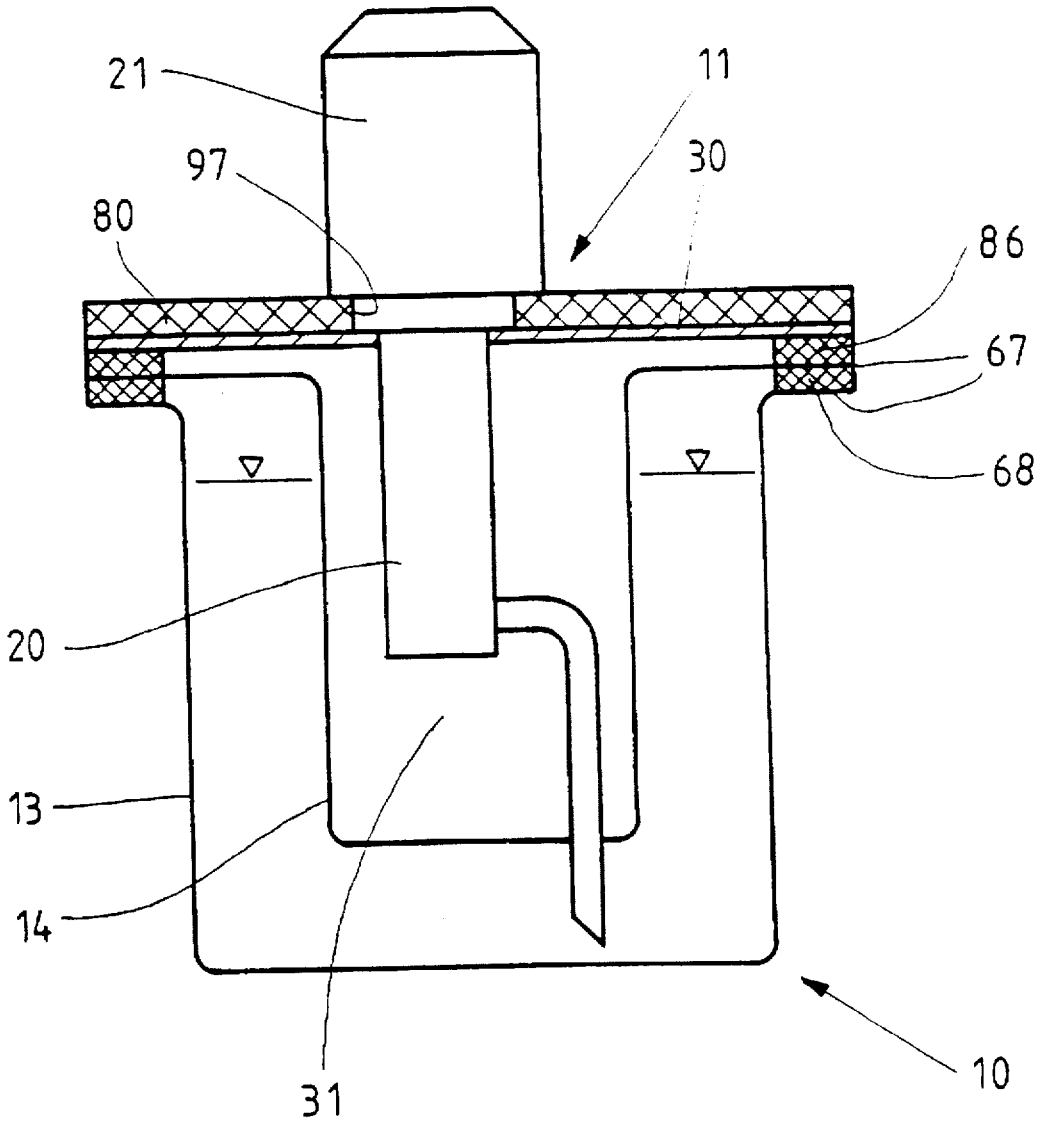
FIG. 12 shows a seventh embodiment, in which only the pump is enclosed.

Differing from all of the embodiments described up to now, in the case of the embodiment of FIG. 12 only the pump 20 of the pump unit 11 is enclosed by the hollow oil container 10 and by a sound-damping plate 80. The hollow oil container 10 is again developed of trough shape with an internal outer wall 14 and an external outer wall 13. Both outer walls are pulled outward at the upper edge of the oil container 10 in flanges 67 and lie there one on top of the other via an elastomeric packing 68. The sound-damping plate 80 has an opening 97 for the passage of the pump unit 11 from the outside into the inner space 31. The weight of the pump unit acts via one or more girders 30 and via damping supports 86 on the flange 67 of the internal outer wall 14 and thus, when oil is present in the oil container 10, acts, reduced by the buoyancy on the internal outer wall 14, on the flange 67 of the external outer wall 13. The girders 30 are located in recesses on the inside of the sound-damping plate 80.

In the hydraulic unit according to FIG. 12, the pump unit 11 can rest in particularly simple manner via girders 30 on the oil container 10. The fact that the interface between the pump 20 and the electric motor 21 is located just at the height of the upper edge of the oil container 30 permits the supporting thereof by a straight girder 30. With the pump, which is cooled by the hydraulic oil, a substantial source of noise of the hydraulic unit is noise-encapsulated. The electric motor is located outside the enclosure, so that no further measures need be taken for the cooling thereof beyond the measures customary on an electric motor. As a result of the vertical arrangement of the pump unit, a hydraulic unit can be obtained which takes up a small amount of floor space.

Pump 20 and electric motor 21 are connected to each other in customary manner via an elastic pump holder, whereby the transmission of solid-conducted noise and of vibrations is substantially avoided. The pump vibrations are isolated and damped by a temperature-resistant and liquid-resistant rubber ring which transmits all forces in form-locked manner. If a rotationally elastic coupling is employed between the motor shaft and the pump shaft, no metallic connection is present any longer between pump and motor. An elastic pump support of customary construction is described, for instance, in the book "Grundlagen und Komponenten der Fluid-Technik Hydraulik" [Principles and Components of Fluid Hydraulics], Vol I., 1991, published by Mannesmann Rexroth GmbH, pages 295 et seq.

In a hydraulic unit in accordance with the invention, a known pulsation damper based on the reflection principle or an intermediate tank acting as volume resonator is inserted with particular advantage in the suction line of the pump and in the inside of the enclosure or in the space receiving the oil. Since the radiation of air-conducted sound by the pump is greatly reduced in a unit in accordance with the invention, the dispersion of noise via the oil container is of greater importance. This dispersion of noise is reduced by the pulsation damper or intermediate tank.

I claim:

1. A hydraulic unit comprising:

a capsule, and a pump unit including a pump disposed in a space within said capsule;

a container disposed within said capsule, said container comprising an internal outer wall and an external outer wall which encloses said internal outer wall and is spaced apart from said internal outer wall to define an oil-receiving space between said internal outer wall and said external outer wall;

a sound-dampening element covering the space in which the pump is disposed; and wherein said internal outer wall is spaced apart from said pump unit to define an inner air-receiving space which separates said oil receiving space from said pump unit to accomplish a damping of sound emanating from said pump unit.

2. A hydraulic unit according to claim 1, wherein said container is a first container, said hydraulic unit further comprising:

a second container for fluid located within and spaced apart from said internal outer wall, said second container enclosing said pump unit, said second container defining a second oil-receiving space, said pump unit being an under-oil pump unit; and conduit means interconnecting the oil-receiving space of said first container with said second oil-receiving space to enable an exchange of oil between said oil-receiving spaces.

3. A hydraulic unit according to claim 1, wherein said pump unit includes an air-cooled electric motor for driving the pump, and a fan wheel driven by the motor for cooling the motor, said sound-damping element being pervious to a stream of cooling air.

4. A hydraulic unit according to claim 3, further comprising an air impervious wall extending from the sound damping element in a plane parallel to a plane of said fan wheel for closing off an open side of the inner space, said air impervious wall being located in a space extending from said internal outer wall to said fan wheel.

5. A hydraulic unit according to claim 1, wherein said pump unit includes an air-cooled electric motor for driving the pump, and a fan wheel driven by the motor for cooling the motor, and said internal outer wall defines an inner space large enough to receive the entire pump unit; and said sound-damping plate is present on one open side of the inner space.

6. A hydraulic unit according to claim 1, wherein said container is configured as a hollow cylinder with two open ends, said sound-damping element being present on each end of the inner space.

7. A hydraulic unit according to claim 1, wherein said container has a trough shape with an open side, and the open side is covered by said sound-damping element.

8. A hydraulic unit according to claim 7, further comprising a machine stand; and wherein said external outer wall of said trough-shaped container is part of said machine stand.

9. A hydraulic unit according to claim 7, wherein said external outer wall of said container is provided on the inner side of its side parts with brackets which serve to support said internal outer wall.

10. A hydraulic unit according to claim 7, further comprising spacers disposed between said outer walls, said spacers being located at bottoms of said outer walls, and;

wherein said internal outer wall is supported on said external outer wall via said spacers.

11. A hydraulic unit according to claim 7, further comprising flange-shaped sections, wherein on said open side, said outer walls are each guided outwards by one of the flange-shaped sections, and the flange-shaped sections rest on each other.

12. A hydraulic unit according to claim 7, wherein said internal outer wall of said container is held down against a buoyancy force acting on it by the pump unit or the second oil container, and at least one of the pump unit and the second oil container is supported by said container.

13. A hydraulic unit according to claim 7, further comprising clamps and an elastomeric packing; and wherein a top end of each of said internal and said external outer walls adjacent said sound damping element extend outward as a flange;

said two outer walls of said container are held together by said clamps with the interposition of said elastomeric packing which extends above a maximum oil level, and between the flanges of said outer walls.

14. A hydraulic unit according to claim 1, further comprising a frame for supporting said container.

15. A hydraulic unit according to claim 14, further comprising a first flange-like section and a second flange-like section and a clamp;

wherein, on an open side of at least one of said outer walls of said container is guided outward by said first flange-like section, and said container is supported on the frame via said second flange-like section; and wherein the frame extends by means of said clamp around the second flange-like section.

16. A hydraulic unit according to claim 1, further comprising a sound-damping element arranged between said pump unit and said internal outer wall of said container.

17. A hydraulic unit according to claim 1, further comprising a pressure line connecting with said pump, and a pulsation damper inserted into said pressure line;

wherein said pulsation damper is located within an inner space of said container bounded by said internal outer wall of said container.

18. A hydraulic unit according to claim 1, further comprising a third container wall enclosing and spaced apart from said external outer wall, there being a hollow space between said external outer wall and said third wall for a flowing of cooling liquid.

19. A hydraulic unit according to claim 1, said container comprises plastic to be suitable for manufacture by blow molding.

20. A hydraulic unit according to claim 1, wherein said container is cylindrical and comprises a maintenance opening which passes through said two outer walls and extends into an inner space of said container.

21. A hydraulic unit according to claim 1, further comprising a suction line connecting with said pump, and pulsating damping means connecting with said suction line;

wherein said pulsation damping means is a pulsation damper or an intermediate tank inserted in said suction line of said pump.

22. A hydraulic unit according to claim 1 further comprising a suction line connecting with said pump, and pulsating damping means connecting with said suction line:

wherein said pulsation damping means is an intermediate tank inserted in said suction line of said pump.

* * * * *